United States Patent [19]

Willenbacher

[11] 4,340,001

[45] Jul. 20, 1982

[54] SEWING MACHINE WITH WORK GUIDING DEVICE

[75] Inventor: Erich Willenbacher, Kaiserslautern, Fed. Rep. of Germany

[73] Assignee: Pfaff Industriemaschinen GmbH, Fed. Rep. of Germany

[21] Appl. No.: 159,394

[22] Filed: Jun. 13, 1980

[30] Foreign Application Priority Data

Jun. 29, 1979 [DE] Fed. Rep. of Germany ..... 2926306

[51] Int. Cl.[3] ..... D05B 35/04

[52] U.S. Cl. ..... 112/143; 112/147; 112/301

[58] Field of Search ..... 112/147, 141, 143, 142, 112/152, 153, 136, 301

[56] References Cited

U.S. PATENT DOCUMENTS

| | | | |
|---|---|---|---|
| 288,529 | 11/1883 | Wellman | 112/153 X |
| 1,111,862 | 9/1914 | Rontke | 112/153 |
| 1,443,702 | 1/1923 | De Voe | 112/141 |
| 1,990,284 | 2/1935 | Hinds | 112/147 |
| 2,880,685 | 4/1959 | Gardner | 112/141 |
| 4,055,127 | 10/1977 | Sharp | 112/143 |

*Primary Examiner*—H. Hampton Hunter
*Attorney, Agent, or Firm*—McGlew and Tuttle

[57] ABSTRACT

A work guiding device for a sewing machine having a sewing needle for joining two overlapping work plies at border areas thereof and folding back at least one border of one work ply comprises first and second U-shaped edge guides which face in opposite direction, a movable support carrying the edge guides and first and second guide rules movable into the vicinity of the needle. A drive is connected through the support and drives are connected to the guide rules to move one of the guide rules and one of the edge guides into the vicinity of the needle to form a channel therebetween for the work plies. The drives comprise double acting cylinders which are controlled by a circuit to selectively use the first edge guide with the first guide rule in a first channel and the second edge guide with the second guide rule in a second channel.

8 Claims, 4 Drawing Figures

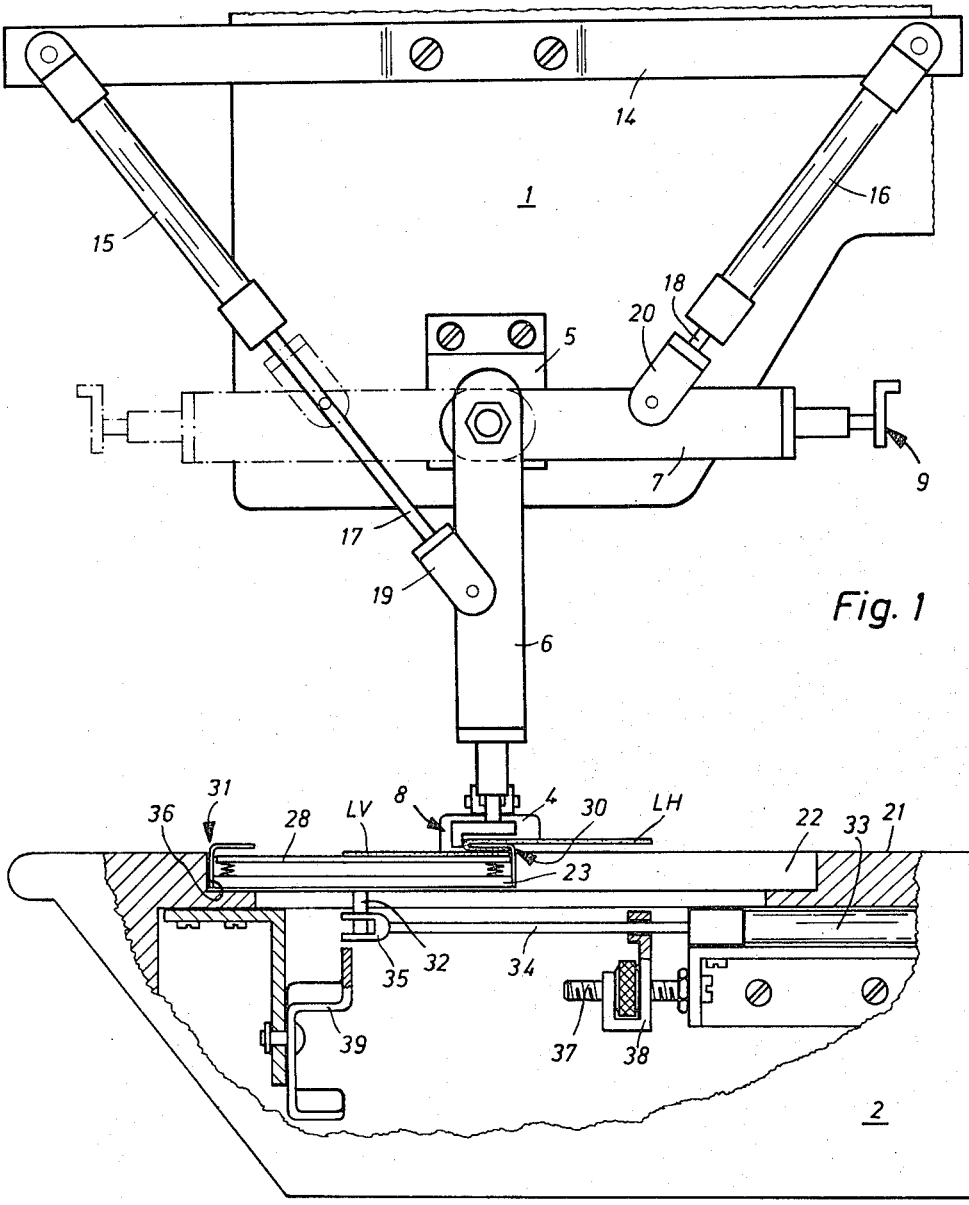
Fig. 1
Fig. 2
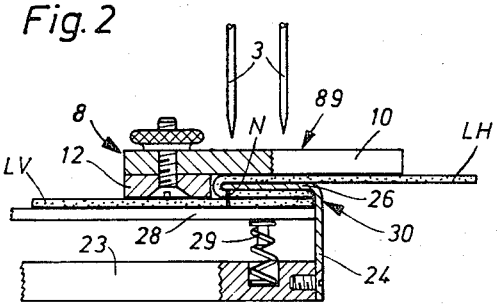
Fig. 3
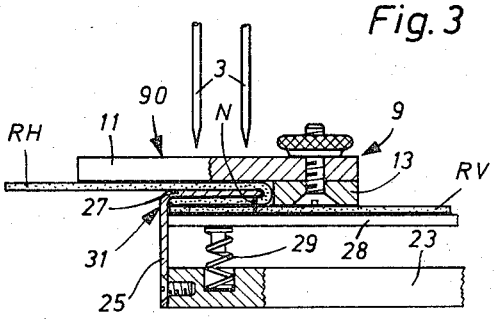

SEWING MACHINE WITH WORK GUIDING DEVICE

FIELD AND BACKGROUND OF THE INVENTION

The present invention relates in general to sewing machines and, in particular, to a new and useful sewing machine for joining two overlapping work plies with a minimum of handling.

While stitching down the side seams of trousers, the rear parts of the trousers are sewn to the front parts. During this operation, the borders of the rear trouser parts are folded back. This manner of joining two overlapping work plies is termed a simple or false lap seam.

If trousers without side pockets are sewn, for example womens' slacks, a guiding device may be used such as disclosed in U.S. Pat. No. 2,547,562 in which fixedly mounted guide parts serve the purpose of guiding the work plies and folding the border of the upper ply. Such guiding devices, however, are unsuitable for stitching down the side seams on trousers with side pockets, since the pocket pouches become caught on the fixed guide parts while sewing the pocket area.

This is why, if trousers with side pockets are to be sewn, a presser foot is provided which is equipped with a resilient guide sole for guiding the folded border of the overlapping rear part of the trousers, which sole can yield during sewing of the pocket area. While using such a presser foot, however, the operator must hold the trouser parts manually against the guide sole during the entire sewing operation, to obtain a seam parallel to the edges of the trouser parts. Since the rear part of the trousers is always sewn onto the front part, the operation must be effected in alternate directions, namely the left-hand trouser parts must be sewn from the waist to the hem and the right-hand trouser parts from the hem to the waist. This requires different stacking of the trouser parts or additional handling for turning the parts prior to assembly. Further, for reasons of manipulation, sewing from the hem to the waist is less expedient than in the opposite direction.

SUMMARY OF THE INVENTION

The present invention provides a sewing machine for joining two overlapping work plies including a device for guiding the work plies and foldng at least one of the work borders back and a guide for the upper and lower work plies. Two U-shaped edge guides are carried in mirror image fashion on a movable support. Two guide rules can be brought into variable lateral positions relative to one or more sewing needles and form, with one of the edge guides, a closed guide channel.

The invention is directed to a device in which the work plies are guided with a minimum of handling and the border of the overlying ply can be folded back to the left hand or right hand side as desired.

By using two guide apparatus which can selectively be brought into working position and of which one folds the border of the upper work part to the left and the other to the right, both the left hand and the right hand trouser parts can be sewn from the waist to the hem during the operation of stitching down the side seams. Another advantage from a handling standpoint is that in their working positions, the guide apparatus, which each include an edge guide and a guide rule, form a substantially closed guide channel for the free edges of the work plies and the back of the border fold.

In this way, the work plies are conducted, during the sewing operation, by the guide apparatus alone, and the operator is thus free to assemble the next two plies to be sewn together.

The guide rules are mounted for pivoting between a rest position and a working position. For this reason, while sewing trousers with side pockets in the area of the pockets, the one of the guide rules which is not in use can be pivoted into its rest position so as to clear the otherwise closed guide channel of the guide apparatus for the passage of the pocket pouch. A development of the invention facilitates sewing in the pocket area, by providing that at least one of the legs of the U-shaped edge guides is mounted resiliently, so that it can yield while the pocket pouch passes through the edge guide.

According to another development of the invention, it is provided that the support and the guide rules are each connected to an air cylinder and that, depending on the position of the edge guides, only the air cylinder connected to that guide rule which is cooperating with a respective guide edge in their work positions is actuated to form the guide channel. In this way, erroneous associations are securely prevented.

It is further provided that the circuit for controlling the air cylinders associated with the support and the guide rules comprises pneumatic component parts only, so that the control is particularly simple and not susceptible to disturbances.

A still further object of the present invention is to provide a sewing machine for joining two overlapping work plies which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

BRIEF DESCRIPTION OF THE DRAWINGS

In the drawings:

FIG. 1 is a partial elevational view of a sewing machine including a guiding device according to the invention;

FIG. 2 is an enlarged view of the component parts of the guiding device in their working position while stitching down left hand trouser parts;

FIG. 3 is a view similar to FIG. 2, showing the stitching of right hand trouser parts.

DESCRIPTION OF PREFERRED EMBODIMENT

Figure 4:
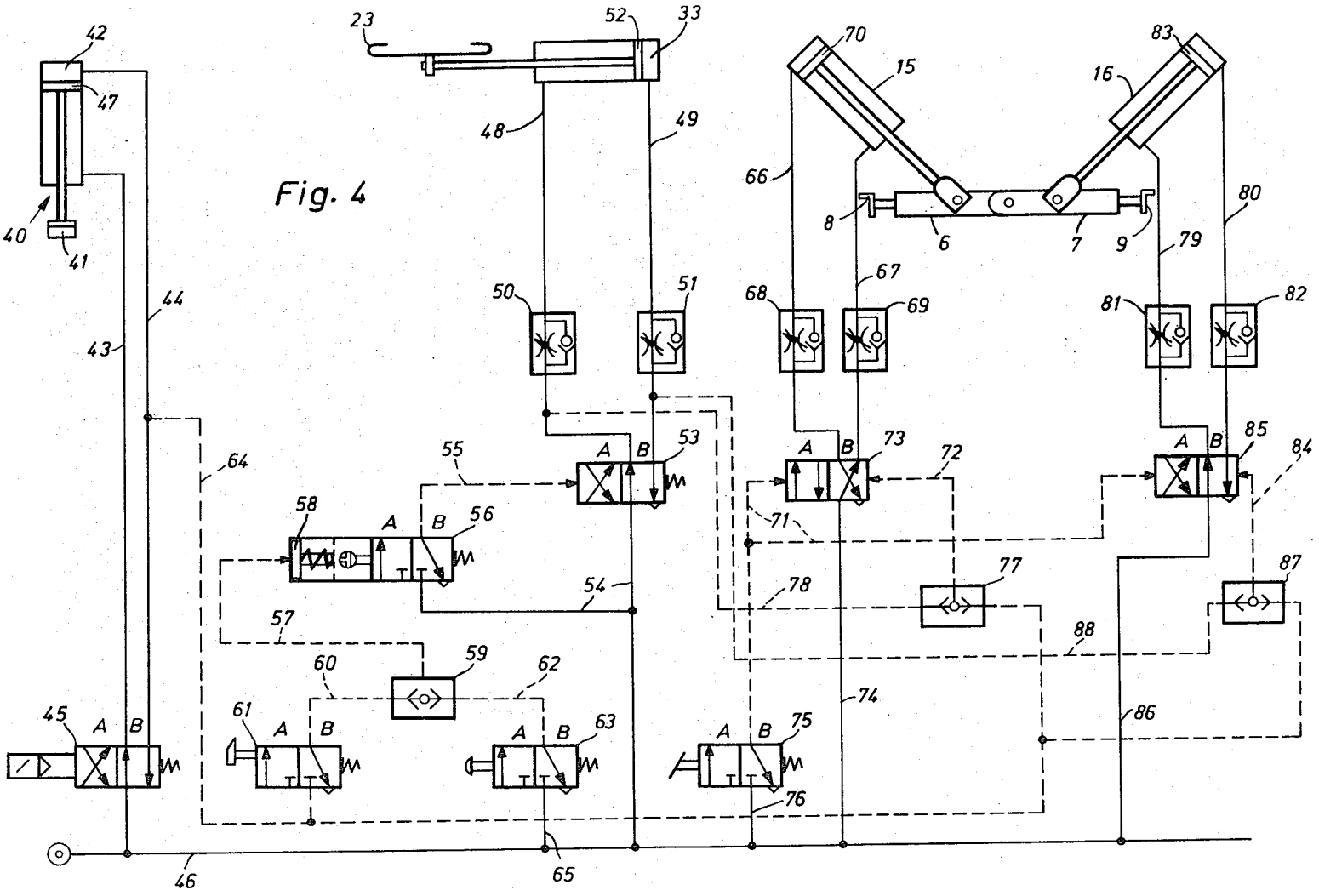
FIG. 4 is a circuit diagram of a pneumatic control of the invention.

Referring to the drawings in particular, the invention embodied therein, in FIG. 1, comprises apparatus connected between a housing head 1 and a lower housing 2 of a known sewing machine.

In FIG. 1, only parts of the housing head 1 and the lower housing 2 of the sewing machine are shown. In housing head 1, two thread guiding needles 3 are clamped in a needle bar (not shown) which moves up and down in a reciprocating motion, and cooperates with a rotary hook provided in lower housing 2, to form stitches. A presser foot 4 is mounted on a presser foot bar (not shown) in known fashion.

Two swing arms 6 and 7 are mounted on a base plate 5 which is secured to the front side of housing head 1. Each swing arm carries a guide rule 8 and 9, respectively. As shown in FIGS. 2 and 3, guide rules 8 and 9 comprise a hold-down plate 10, 11 which extends horizontally in its working position, and a guide strip 12, 13 screwed thereto. Two double-acting air cylinders 15 and 16 are hinged to a cross bar 14 which is secured to the front side of housing head 1. Piston rods 17 and 18 of cylinders 15 and 16, are connected to swing arms 6 and 7 through fork heads 19 and 20 respectively.

A shallow recess 22 is provided in the bed plate 21 of lower housing 2 which accommodates a thread support 23 which itself is displaceable transversely to the sewing direction. Two angle pieces 24 and 25 are secured to the opposite short sides of support 23, as viewed in the cross-section of FIGS. 2 and 3, with their horizontally extending legs 26, 27, directed opposite to each other. Support 23 carries a pressure plate 28 which is urged against legs 26, 27 of angle pieces 24, 25 by means of compression springs 29. Along with the respective portions of pressure plate 28 extending in their area, angle pieces 24, 25 form two symmetrical, U-shaped edge guides 30, 31.

Support 23 carries on its underside a pin 32 which extends downwardly through a slot provided in bed plate 21. Lower housing 2 accommodates a double-acting air cylinder 33 whose piston rod 34 carries a fork head 35 engage pin 32. If the sewing operation is performed with a single needle 3, the left hand side face 36, as viewed in FIG. 1, of recess 22 serves as a stop surface for support 23. The right hand stop is formed by a stop member 38 which is carried on a fixed threaded pin 37 and is displaceable thereon by means of a setting nut, to cooperate with fork head 35. If the sewing operation is performed with two needles 3, edge guides 30, 31 are positioned less eccentrically relative to presser foot 4. For this purpose, a stop lever 39 is provided which can be pivoted from a rest position into a working position in which it cooperates with fork head 35 to serve as the left-hand stop. Upon a corresponding adjustment, stop member 38 again serves as a right hand stop.

The sewing machine is further equipped with a thread cutter 40 (see FIG. 4) comprising a knife 41. The cutter is driven by a double-acting air cylinder 42.

Air cylinder 42 is connected to two pressure lines 43 and 44 which can alternately be supplied with compressed air through an electomagnetically actuable switch valve 45. In the switching position B of valve 45, pressure line 43 is connected to the main pressure line 46 which is supplied from a source of compressed air, so that piston 47 of air cylinder 42 is lifted. In this position of piston 47, knife 41 of cutter 40 is in its rest position.

The air cylinder 33 associated with support 23 is connected to two pressure lines 48 and 49, each equipped with a flow-control check valve 50, 51 intended to reduce the speed of piston 52. Pressure lines 48, 49 can alternately be connected, through a switch valve 53, to a line 54 which is permanently supplied with compressed air. Switch valve 53 is brought into its B position by a spring and into its A position pneumatically through a control line 55. In the switching position B of valve 53, pressure line 48 is supplied with compressed air so that piston 52, and thereby support 23, are shifted into their right hand positions.

Control line 55 is connected to a pulse-controlled binary valve 56 which switches from one to the other position upon every switching pulse, for example from A to B, and next time from B to A. The switching pulse, coming as a compressed air impulse from a pulse control line 57, is transmitted by means of a spring-loaded piston 58, to binary valve 56. Pulse control line 57 is connected to the output of a double check valve 59 acting as an OR element and having one of its inputs connected to a pulse control line 60 which is equipped with a hand-actuated, spring-loaded switch valve 61, and its other input connected through a control line 62 to a key-actuated valve 63. Switch valve 61 is connected through a pulse control line 64 to the pressure line 44 of air cylinder 42 associated with cutter 40, and valve 63 is connected through a pressure line 65 to the main line 46.

The air cylinder 15 associated with swing arm 6 and guide rule 8, is connected to two pressure lines 66 and 67 which are each equipped with a flow control check valve 68 and 69 for reducing the speed of piston 70. Pressure lines 66, 67 can be connected, through a switch valve 73 which is pneumatically actuable by means of two control lines 71, 72 to pressure line 74 which is permanently supplied with compressed air. In the switching position B of valve 73, pressure line 67 is supplied with compressed air, so that piston 70 occupies the position shown in FIG. 4. This means that guide rule 8 is in its lifted, rest position. Control line 71 is connected to main line 46 through a spring-loaded switch valve 75 which is used as a knee-operated switch, and a pressure line 76. Control line 72 is connected to the output of a double check valve 77 acting as an OR element and having one of its inputs connected to pulse control line 64 and its other input connected to a control line 78. Control line 78 is connected to pressure line 48.

The air cylinder 16 associated with swing arm 7 and guide rule 9 is connected to two pressure lines 79 and 80 which are each equipped with a flow-control check valve 81 and 82, to reduce the speed of piston 83. Pressure lines 79, 80 can be connected through a switch valve 85 pneumatically actuable by means of control line 71 and a control line 84, to a pressure line 86 which is permanently supplied with compressed air. In the switching position B of valve 85, pressure line 79 is supplied with compressed air, so that piston 83 occupies the position shown in FIG. 4. This means that guide rule 9 is in its lifted, rest position. Control line 84 is connected to the output of a double check valve 87 acting as an OR element and having one of its inputs connected to pulse control line 64 and its other input connected to a control line 88. Control line 88 is connected to pressure line 49.

The device operates as follows:

The guiding device, equipped with air cylinders 15, 16 and 33 with the associated valves, is put in operation manually by switching switch valve 61 into its position A.

At the end of a sewing operation, and as the end edges of the trouser parts, which were sewn together, leave the area of presser foot 4, cutter 40 is switched on, through a photocell control (not shown), by switching valve 45 from its position B into position A. Thereby, pressure line 43 is vented and pressure line 44 is supplied with compressed air, so that piston 47 is displaced downwardly and knife 41 cuts the threads between the sewn trouser parts and the stitch forming area. Immediately after the downward movement of knife 41, valve 45 is switched again, so that knife 41 returns upwardly into its rest position where it remains until the sewing of the next trouser parts is finished.

Due to the momentary supply of pressure line 44 with compressed air, a short, pulse-like pressure builds up in pulse control line 64. This pressure pulse is transmitted through switch valve 61, pulse control line 60, double check valve 59, and pulse control line 57 to piston 58, by which binary valve 56 is switched from its position B into position A. In this switching position, control line 55 is supplied with compressed air from pressure line 54, whereupon valve 53 is pneumatically switched from its position B into position A. As a result, pressure line 48 is vented and pressure line 49 is supplied with compressed air, so that piston 52 and support 23 are displaced from the right hand into the left hand position, according to FIGS. 1 and 2. Support 23 or fork head 35, depending on whether one or two needles 3 are used in the sewing operation, abuts against side face 36 or stop lever 39, respectively.

The pressure pulse produced upon actuation of cutter 40 in pulse control line 64 is transmitted not only to binary valve 56 but at the same time also to switch valves 73, 85, through double check valves 77, 87. Since at that time switch valve 75 is in its B position, the pressure pulse effects a switching of valves 73, 85 into their B positions, or holds them in these positions. With valves 73, 85 in their B positions, pistons 70, 83 of air cylinders 15, 16 are displaced upwardly, or remain in their upper position, so that the two swing arms 6, 7 with the guide rules 8, 9 occupy a lifted, rest position.

After support 23 comes into its new position, the next trouser part can be put in place. In the left hand position of support 23, shown in FIGS. 1 and 2, left hand trouser parts are sewn, the front trouser part being designated LV and the rear part LH. The trouser parts, which have earlier been joined to each other in another sewing machine by a side seam N, are inserted into the guiding device with the front part LV below and with the free edges of both parts, LV and LH, abutting against angle piece 24 within edge guide 30. Then, the overlying rear part LH is folded back, over leg 26 of angle piece 24.

Upon putting the trouser parts in place, first with guide rule 8 still in its lifted position, the side seam N is stitched in the pocket area. After the sewing in the pocket area, the operator switches valve 75, designed as a knee-operated switch, from its position B into position A, whereupon control line 71 leading to the two stitch valves 73, 85 is supplied with compressed air. During this time, the pressure line 48 leading to air cylinder 43 is vented, and also control line 78 connected thereto and control line 72 are vented. Therefore, since no pressure in control line 72 opposes in valve 73 the pressure present in control line 71, this pressure in line 71 effects a switching of valve 73 from its position B into position A. As a result, pressure line 67 is vented and pressure line 66 is supplied with compressed air, whereupon swing arm 6 with guide rule 8 is pivoted downwardly by air cylinder 15, into its working position shown in FIGS. 1 and 2. Thereby, hold-down plate 10 is applied against the folded back rear trouser part LH, and guide strip 12 is applied against the back of the fold, so that edge guide 30 and associated guide rule 8 form a guide apparatus 89 defining a substantially closed guide channel. In this way, trouser parts LV and LH are guided solely by guide apparatus 89 and the operator can pay attention to other work during this sewing operation.

At the actuation of switch valve 75 as described above, and during the entire duration of this sewing operation, pressure line 49 is supplied with compressed air. Therefore, control lines 88 and 84 connected thereto are also under pressure. Since the pressure in control line 84 is opposed to the pressure in control line 71, valve 85 cannot be switched into its position A, and swing arm 7 with guide rule 9 remains in its rest position. This ensures that in the left hand position of support 23 shown in FIG. 1, only the proper guide rule 8 forming the guide apparatus 89 with edge guide 30 can be brought into engagement.

Upon pivoting guide rule 8 into its working position, the operator releases switch valve 75 which is then returned into its position B by the spring. Control line 71 is thereby vented. Since control line 72 is also vented at this time, switch valve 73 remains in its position A during the sewing operation.

At the end of the sewing operation, cutter 40 is actuated as already described above and the thread between the sewn trouser parts LV and LH and the stitch forming area is severed. Again a pressure pulse is produced in pulse control line 64 by which binary valve 56 is switched, in this instance from its position A into position B. Consequently, control line 55 is vented and switch valve 53 is returned by its spring into position B. Due to the switching of valve 53, piston 52 of air cylinder 33 and support 23 are displaced from their left hand position into their right hand position shown in FIGS. 3 and 4, the exact position of support 23 being determined by stop member 38.

The pressure pulse produced at the actuation of cutter 40 in pulse control line 64 is transmitted not only to binary valve 56 but at the same time also to switch valves 73, 85, so that valve 73 still occupying its position A is switched into position B, while valve 85 which already was in position B remains in this position. The switching of valve 73 causes a reversal of air cylinder 15 and swing arm 6 with guide rule 8 is pivoted upwardly into its rest position.

With support 23 in its new position, the next trouser parts can be put in place. Now, with support 23 in the right hand position shown in FIGS. 3 and 4, right hand trouser parts are sewn, the front and rear parts of which are designated RV and RH respectively in the drawing. With the trouser parts in place, first, with guide rule 9 in lifted position, the side seam N is secured with stitches in the pocket area. Then, as before, the operator actuates switch valve 75, so that control line 71 is supplied with compressed air. Since at this time, pressure line 49, control line 88 connected thereto, and control line 84 are vented, the pressure in control line 71 effects a switching of valve 85 into position A. As a result, swing arm 7 with guide rule 9 is pivoted by air cylinder 16 downwardly into the working position shown in FIG. 3, and edge guide 31 along with guide rule 9 form a guide apparatus 90 defining a substantially closed guide channel.

During the above described actuation of switch valve 75, pressure line 48, control line 78 connected thereto and control line 72 are under pressure, so that valve 73 cannot be switched into its position A. Therefore, swing arm 6 and guide rule 8 remain in their rest position during sewing of the right hand trouser parts RV, RH. This ensures that with support 23 in its right hand position shown in FIGS. 3 and 4, only the proper guide rule 9 forming with edge guide 31 the guide apparatus 90 always can be engaged.

Due to the provision of controlling the air cylinders 15, 16 of guide rules 8, 9 by means of pneumatically actuable switch valves 73, 85 and of blocking these valves against switching from a position B into a position A in which guide rules 8, 9 are pivoted by air cylinders 15, 16 into their working position, and by means of a blocking pressure which is transmitted from the respective supply line 48, 49 under pressure of air cylinder 73 moving support 23, it is obtained, with the aid of pneumatic means alone, that, depending on the position of support 23, in every instance only the guide rule 8 or 9 associated with the respective edge guide 30 or 31, can be brought into engagement.

While a specific embodiment of the invention has been illustrated and described in detail to illustrate the application of the principles of the invention, it will be understood that the invention may be embodied otherwise without departing from such principles.

What is claimed is:

1. A work guiding device for a sewing machine having a sewing needle for joining two overlapping work plies at border areas thereof and folding back at least one border of one work ply comprising, a movable support, first and second U-shaped edge guides connected to said support and facing opposite directions, support drive means connected to said support for moving one of said edge guides at a time into the vicinity of the needle, first and second guide rules each movable into the vicinity of the needle and each forming with each of said edge guides respectively a substantially closed channel for the work plies, and drive means connected to said first and second guide rules for selectively moving said guide rules into the vicinity of the needle.

2. A work guiding device according to claim 1, wherein a first channel is formed by said first edge guide and said first guide rule and a second channel is formed by said second edge guide and said second guide rule, said support drive means comprising a support air cylinder and said first and second guide rule drive means comprising first and second guide rule air cylinders, and means connected to said first and second guide rule air cylinders for activating only that one of said first and second guide rule air cylinders which moves that one of said first and second guide rules which forms with said first and second edge guide a channel.

3. A work guiding device according to claim 2, wherein each of said air cylinders comprises a double acting cylinder, said means for activating said first and second guide rule air cylinders comprising first and second pneumatically actuable switch valves connected to said first and second guide rule air cylinders respectively, a pair of control lines connected to each of said pneumatically actuable switch valves, one of said control lines on each of said pneumatically actuable switch valves provided for switching said pneumatically actuable switch valves to move said guide rules into the vicinity of the needle, a manually operable switch valve connected to each of said one control lines, the other control line of one of said pneumatically actuable switch valves connected to a pressure line for said support air cylinder and the other control lines of the other of said pneumatically actuable switch valves connected to another pressure line for said support air cylinder, said one pressure line provided for moving said support in one direction and said other pressure line provided for moving said support in an opposite direction.

4. A work guiding device according to claim 3, including cutting means for cutting sewing thread of the needle comprising a cutting air cylinder and a knife connected to said cutting air cylinder, a support switch valve connected to said pressure line of said support air cylinder, said support switch valve actuable to move each of said edge guides into the vicinity of the needle, a support switch valve control line connected to said support switch valve for actuating said support switch valve, and pneumatically actuable pulse controlled binary valve means connected to said control valve and to a pressure line of said cutting means air cylinder.

5. A work guiding device according to claim 4, wherein said pneumatically actuable pulse controlled binary valve includes a pulse control line, an OR element connected to each of said pneumatically operable switch valves, the other control line of each of said pneumatically actuable switch valves each connected to a respective one of said OR elements with one of said other control lines connected at a time to the respective one and other pressure line of said support air cylinder.

6. A work guiding device according to claim 1, wherein at least one leg of each U-shaped edge guide is movably and resiliently mounted.

7. A work guiding device according to claim 1, wherein said support drive means comprises a double acting air cylinder, said first and second guide rule drive means comprising first and second double acting guide rule air cylinders, a pair of pressure lines connected to each of said support and guide rule cylinders, first and second switches connected to the pressure lines of said first and second guide rule air cylinders, a support switch connected to the pressure lines of said support air cylinder, a pair of control lines connected to each of said first and second switches, a manual switch connected to one control line of each of said pairs of control lines operable to move one of said first and second switches into a position to move one of said guide rules into the vicinity of the needle, each other control line of each pair of control lines connected to one of the pressure lines of said support air cylinder respectively, and one control line connected to said support switch for activating said support switch to move one of said edge guides into the vicinity of the needle, whereby a manual activation of said manual switch will move that one of said guide rules into the vicinity of the needle to form with that one of said edge guides in the vicinity of the needle a guide channel.

8. A work guiding device according to claim 7, including a pulse controlled binary valve connected to said control line of said support switch, a cutter blade cylinder having a pair of pressure lines, a cutter switch connected to said cutter blade cylinder pressure lines for moving a cutter blade, said pulse controlled binary valve operable when said cutter blade is moved to change the position of said support.

* * * * *